United States Patent [19]

Folkmar

[11] Patent Number: 4,811,465

[45] Date of Patent: Mar. 14, 1989

[54] CLOSURE FOR THE FLUID-TIGHT CLOSING OF BAGS, THIN-WALLED TUBES AND THE LIKE

[75] Inventor: Jan Folkmar, Zurich, Switzerland

[73] Assignee: Ice-Pack Service AG, Zurich, Switzerland

[21] Appl. No.: 223,723

[22] Filed: Jul. 21, 1988

Related U.S. Application Data

[63] Continuation of Ser. No. 032,338, filed as PCT EP86/00449 on Jul. 29, 1986, published as WO87/01097 on Feb. 26, 1987, abandoned.

[30] Foreign Application Priority Data

Aug. 20, 1985 [DK] Denmark ..... 3781

[51] Int. Cl.[4] ..... B65D 77/10

[52] U.S. Cl. ..... 24/30.5 R; 24/487; 24/559

[58] Field of Search ..... 251/10; 24/30.5 R, 30.5 P, 24/487, 543, 559, 462

[56] References Cited

U.S. PATENT DOCUMENTS

| | | | |
|---|---|---|---|
| 3,141,221 | 7/1964 | Faulls, Jr. | 24/462 X |
| 3,363,293 | 1/1968 | Nemrod et al. | 24/30.5 P |
| 3,571,861 | 3/1971 | Olson . | |
| 3,621,539 | 11/1971 | Agers | 24/30.5 R |
| 4,231,141 | 11/1980 | Derrick et al. | 24/462 |
| 4,291,698 | 9/1981 | Fuchs et al. | 24/543 X |
| 4,416,038 | 11/1983 | Morrone | 24/487 |
| 4,534,089 | 8/1985 | Swan | 24/559 |
| 4,648,160 | 3/1987 | Spinosa et al. | 24/30.5 R X |
| 4,656,697 | 4/1987 | Naslund | 24/543 X |

FOREIGN PATENT DOCUMENTS

| | | | |
|---|---|---|---|
| 1286849 | 1/1962 | France . | |
| 1341025 | 9/1963 | France . | |
| 1522441 | 4/1968 | France | 24/559 |

*Primary Examiner*—Kenneth J. Dorner
*Assistant Examiner*—James R. Boothan
*Attorney, Agent, or Firm*—Nolte, Nolte and Hunter

[57] ABSTRACT

A closure (10) for a bag (not shown), such as a plastic bag for freezing shaped lumps of ice for cooling drinks, consists of a channel member (14) adapted to receive an insertion member (16). Before the insertion member (16) is pressed into the channel member (14), the end of the bag (not shown) is inserted between the two, being closed in a fluid-tight manner when the two members, in the example shown interconnected by a hinge (27), are pressed together.

The closure makes it possible to close bags for freezing ice lumps in a fluid-tight manner, allowing the bags to lie down in a deep-freeze cabinet without leaking and also making it easier to open the bags than when these are closed by means of knots of the like.

6 Claims, 2 Drawing Sheets

CLOSURE FOR THE FLUID-TIGHT CLOSING OF BAGS, THIN-WALLED TUBES AND THE LIKE

This is a continuation of application Ser. No. 07/032,338, filed as PCT EP86/00449 on Jul. 29, 1986, published as WO87/01097 on Feb. 26, 1987, abandoned.

The present invention relates to a closure of the kind set forth in the preamble to claim 1.

Such a closure has previously been disclosed in U.S. Pat. No. 3,060,985 (J.R. Vance et al). In this Prior Art closure, the male part consists of a resilient strip of plastics material, which has to be bent into channel shape before being inserted into the channel member. Considering the fact that it will at the same time be necessary to hold the end of the bag in the correct relative position between the female part and the male part, i.e. between the channel member and the strip, it will be evident that closing a bag with such a closure is not a quite simple matter, but requires at least some degree of dexterity, not always to be expected from persons likely to use a deep-freeze cabinet or the deep-freeze section of a refrigerator for making lumps of ice for cooling drinks. Further, this Prior Art closure is to be opened by creating a fluid pressure within the bag, such as by pressing the side of the bag, but this is obviously not possible, when the contents are frozen.

The novel features of the closure according to the present invention are set forth in the characterizing clause of claim 1.

A closure comprising these features may be closed in the same manner as a snap fastener by pressing the female part and the male part into mutual engagement with the part of the bag or tube to be closed in-between. Conversely, the closure may be opened by simply pulling the two parts away from each other.

Attention is drawn to the fact that the German Auslegeschrift No. 1,921,345 (Prym-Werke) discloses a closure for bags in the form of a snap fastener that may be closed with the two sides of the bag placed between the female and male parts of the closure. In this Prior Art closure, however, the female and male parts are shaped with surfaces of revolution, i.e. like the corresponding parts of a normal snap fastener for clothing etc., and not elongate like the corresponding parts of the closure according to the invention, for which reason it cannot be used for fluid-tight seam closing, but only for point-wise closing of bags.

Figure 1:
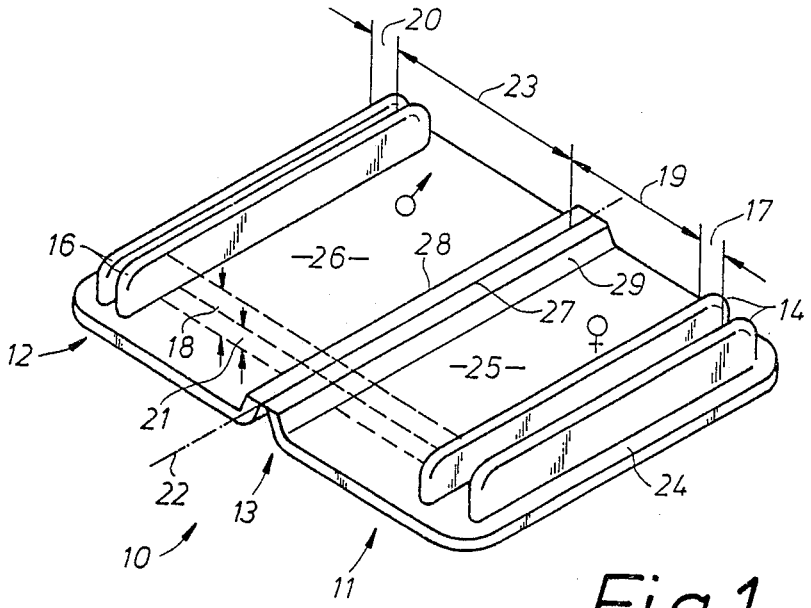
Figure 2:
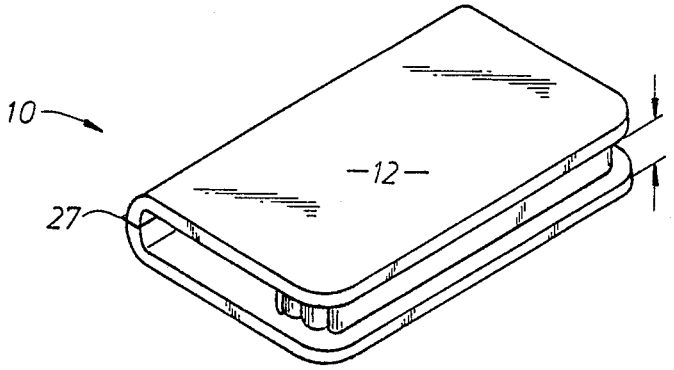
Figure 3:
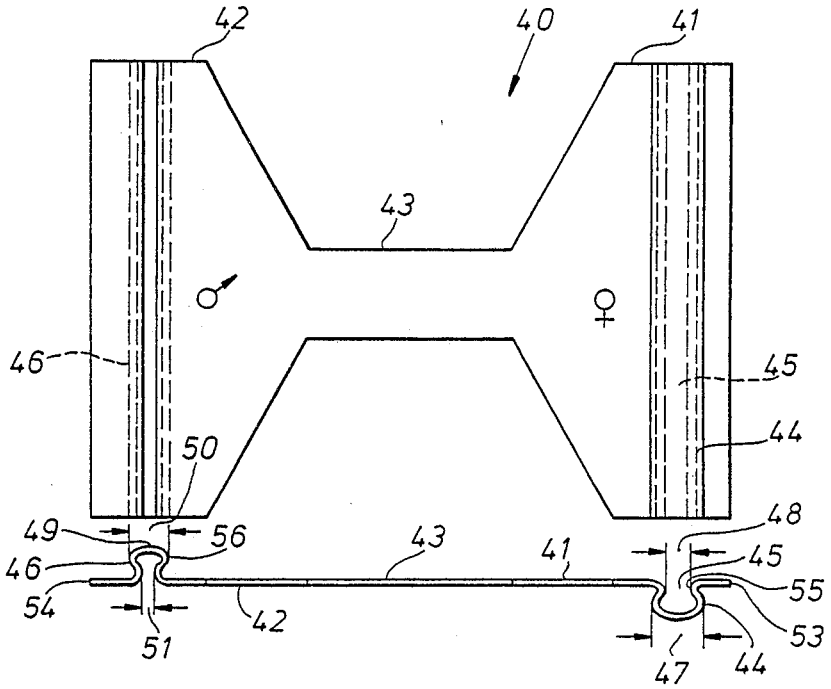

The invention is now to be explained in more detail with reference to the drawings, in which FIG. 1 in perspective shows a first exemplary embodiment of a closure according to the present invention, in the open state, FIG. 2 shows the closure of FIG. 1, also in perspective, but in the closed state, FIG. 3 shows another exemplary embodiment of a closure according to the invention, viewed at right angles to and parallel to the main plane of the closure in the un-stressed condition respectively, and FIG. 4 in a somewhat larger scale shows the closure of FIG. 3 in a position, in which it keeps a bag closed.

The closure 10 shown in FIGS. 1 and 2 consists of a female part 11 and a male part 12, hingedly interconnected by a hinged interconnecting member 13 in such a manner that by moving the two parts 11 and 12 together from the position shown in FIG. 1 to the position shown in Figure 2, an insertion member 16 on the male part 12 is inserted into engagement with a channel member 14 on the female part 11. When using the closure 10 for its intended purpose, i.e. for closing a thin-walled bag or tube of plastic foil or the like, the end of the bag or tube (not shown) is placed between the insertion member 16 and the channel member 14 before these two members are brought into final engagement, thus closing the end of the bag or tube in question. It should be noted that the edges of the channel member 14 and the insertion member 16 are rounded, both to protect the bag or tube being closed and to facilitate the interengagement of the two members.

While in the example shown in FIGS. 1 and 2, the hinge axis 22 is substantially parallel to the insertion member 16 and the channel member 14, the same closing effect would be attained within the scope of the present invention by arranging the hinge axis at an angle to each of these two members, provided that they meet in mutual engagement when the closure is closed.

In the exemplary embodiment shown in FIGS. 1 and 2, the closure 10 substantially consists of a comparatively rigid plastics material, such as for example polystyrene or unsoftened polyvinyl chloride, while only the hinge 27 is made from more flexible material, such as a thin sheet of polyester with a thickness permitting the requisite flexing, interconnecting the edges of the female and male parts 11 and 12 respectively at a sufficiently small mutual distance to provide the effect of a hinge with a reasonably well-defined axis 22—sufficiently well-defined for the hinge 27 to guide the two members 16 and 14 into mutual engagement when the closure 10 is being closed. If the hinge 27 is made in the manner indicated, it may be cemented or welded to the two parts 11 and 12 in a suitable manner. It would also be possible, however, to form the hinge 27 as an integral part of a moulded article comprising also the female and male parts 11 and 12 respectively, in which case the material used would need to have the requisite properties with regard to flexibility and rigidity, i.e. flexible enough for the hinge effect to be attained, but rigid enough for the female and male parts 11 and 12 to cooperate in the manner indicated in closing a bag or tube (not shown) having been placed between the insertion member 16 and the channel member 14 before their final mutual engagement.

In the exemplary embodiment shown in FIGS. 1 and 2, each of the channel member 14 and the insertion member 16 is formed as a pair of walls protruding at substantially right angles from the female and male parts 11 and 12 respectively, the latter substantially consisting of flat pieces of material with—apart from the channel and insertion members just mentioned—only a hinge carrier 28 and 29 respectively protruding to the same side as said members. The channel member 14, the insertion member 16 and the hinge carriers 28 and 29 are so dimensioned that the axis height 21 above the upper (as shown in FIG. 1) flat side 25 and 26 of the female and male parts 11 and 12 is substantially one-half of the height 18 with which the channel member 14 and the insertion member 16 protrude in the same direction. This will, or course, result in the closure 10 closing in the manner shown in Figure 2 with the latter height 18 being the spacing between the two parts 11 and 12. If the internal width 17 is substantially equal to the external width 20 and the walls constituting the channel member 14 and the insertion member 16 extend at right angles to the said upper flat sides of the female and male parts 11 and 12 respectively, and provided the radial distances 19 and 23 from the hinge axis 22 of the internal and external walls respectively of the channel member 14 and the insertion member 16 closest to the hinge axis 22 are also substantially equal, then there will be a certain "over-centre" action in the first stages of the bringing together of the channel member 14 and the insertion member 16, as will be obvious from a consideration of the geometry of the components involved. This "over-centre" action may be likened to a snap action improving the mutual hold of the two members 14 and 16 in the closed state of the closure 10 as shown in FIG. 2.

The internal width 17 of the channel member 14 will, of course, have to be at least roughly equal to the external width 20 of the channel member 16, although the relative dimensioning chosen will depend on the nature of the material used for the closure and the expected thickness of the bag or tube to be closed.

As can be seen from FIGS. 1 and 2, both the channel member 14 and the insertion member 16 are placed at a small distance from the edges of the female and male parts 11 and 12 respectively, so as to form a gripping flange 24 facilitating the opening of the closure 10, when it is desired to open the bag or tube in question and/or to recover the closure.

In the exemplary embodiment shown in FIGS. 1 and 2, the insertion member 12 consists of two substantially parallel walls protruding from the male part 12. This construction gives a desirable resilience, but if the resilience of the channel member 14 alone is considered sufficient, then the insertion member 16 may be solid or tubular, or have some other shape with reduced resilience.

In the exemplary embodiment shown in FIGS. 1 and 2, the internal surfaces of the channel member 14 and the cooperating external surfaces of the insertion member 16 are substantially parallel, as a certain degree of snap action will be provided even with such a construction. If a higher degree of snap action is desired, then the two members may be profiled accordingly, such as will be illustrated in the following description of a second exemplary embodiment of a closure according to the present invention, shown in FIGS. 3 and 4.

Figure 4:
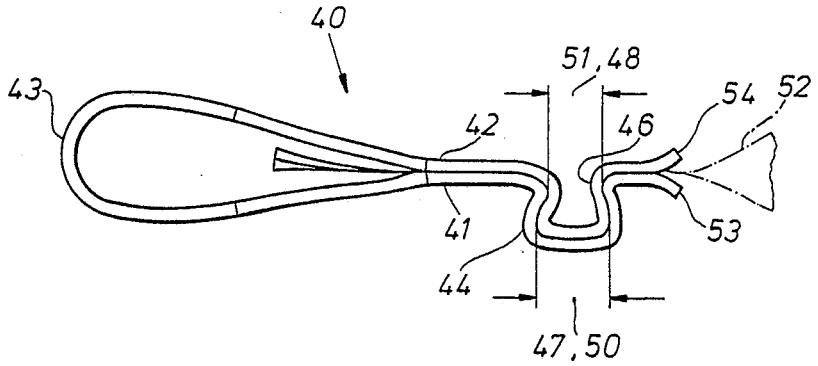

The closure 40 shown in FIGS. 3 and 4 consists in general of a female part 41, a male part 42, and a flexible interconnection bridge 43. The female part 41 comprises a channel member 44, the opening 45 of which faces towards the viewer and upwards respectively in the two views of FIG. 3. The male part 42 comprises an insertion member 46 facing in the same direction as the opening 45 of the channel member 44 when the closure 40 is un-flexed as shown in FIG. 3.

Although the insertion member 46 is channel-shaped in the exemplary embodiment shown, it need not necessarily be so shaped. It may, for example, be solid or tubular, provided that its external shape fulfils the requisite conditions for the correct functioning of the closure 40. Further, in the exemplary embodiment shown in FIGS. 3 and 4 the bridge 43 is flexible, although a hinged member may be used in its place, provided again that the requisite functional conditions are fulfilled. These conditions will be evident from the following.

As will be evident from FIG. 3, the channel member 44 has a first internal width 47 some distance from the opening 45, and a somewhat smaller second internal width 48 closer to the opening 45. Correspondingly, close to its free end face 49, the insertion member 40 has a first external width 50 that is greater than the second internal width 45 of the channel member 44. A second external width 51 more distant from the end face 49 is smaller than the first external width 50, and at least roughly equal to or somewhat smaller than the second internal width 48 of the channel member 44.

When the closure 40 is to be used, the bridge 43 is flexed in such a direction, i.e. with its middle part bending away from the viewer and downwards respectively in the two views shown in FIG. 3, that the female part 41 and the male part 42 are brought closer to each other with the opening 45 in the channel member 44 facing the free end face 49 on the insertion member 46. In a position (not shown), in which there is still a distance between the two members 44 and 46, the open end of a thin-walled tube or bag 52—of which only the end portion is shown in FIG. 4— is inserted into the space between the two members 44 and 46, which are then brought together with the insertion member 46 pressed into the channel member 44 as shown in FIG. 4. The edges of the female and male members 41 and 42 may be rounded or flared as shown at 53 and 54 respectively to avoid injury to the thin-walled tube or bag 52, which—especially when it is a bag for freezing ice in compartments in the bag, at present the preferred use of the closure according to the invention— may have extremely thin walls with a thickness of the order of 0.01 mm.

As will be evident from the drawings, it is a prerequisite for the proper functioning of the closure 40 that either the edges 55 at the entrance of the channel member 46 or the edges on both sides of the free end face 49 of the insertion member 46, or—preferably—both— are rounded (as shown) or chamfered, so as to make it possible to press the insertion member 46 into engagement with the channel member 44 as shown in FIG. 4.

This is, of course, analogous to the conditions for the proper functioning of snap fasteners and the like. The rounded shape shown is preferred to avoid injury to the thin-walled tube or bag 52, when the two members 44 and 46 are being brought into mutual engagement.

Further, it will also be evident that it is a further prerequisite for the proper functioning of the closure 40 that either the channel member 44 be capable of being expanded elastically or the insertion member 46 be capable of being compressed elastically (both in directions at least roughly parallel to the widths mentioned above) or —preferably— both. To this end, the entire closure 40 may be formed from a suitable plastics material, such as polyethylene or polypropylene exhibiting the requisite elastic properties, with a thickness ensuring the requisite force to close the end of the thin-walled tube or bag 52 in a sufficiently fluid-tight manner. A person skilled in the art of making articles of plastics material will be able—by calculation or experiment or both— to find the right material and dimensions. It should be noted that a certain degree of "creep" may be allowed, when the closure is to be used for closing ice freezing bags or the kind referred to above, as the fluid pressure exerted by the water in the bag will disappear as soon as the water has been frozen to ice.

In the exemplary embodiment shown, the shape of the female part 41 is somewhat different from the shape of the male part 42, and the two parts are placed on each end of a flexible interconnecting bridge 43. It is, however, also possible within the scope of the invention in a manner not shown in the drawings to use two identically shaped channel-shaped members with such a shape, thickness and elastic properties that one may be pressed into engagement with the other with the end of thin-walled tube or bag—such as the one shown at 52 in FIG. 4— in-between. These two identically shaped members could be unattached or attached to each other, such as in the manner shown in FIGS. 3 and 4, or by means of a hinged member, cords or chains.

To open the closure 40 from the closed condition shown in FIG. 4, the two parts 41 and 42 may be pulled apart by inserting a finger of each hand in the loop formed by the flexible bridge 43 and pulling in directions at right angles to the plane of the parts 41 and 42. Another possibility is to insert a table knife or the like between the two rounded edges 53 and 54. A third possibility would be to extend the side walls in the channel member 44 downwards in FIG. 4 to form levers or handles (not shown), which when pressed together would open the channel member 44.

I claim:

1. A clamp for fluid-tight closing of containers such as bags and thin-walled tubes comprising a female part and male part each comprising a flat piece made from plastic wherein the female part comprises an elongate channel member being open at its one side and projecting vertically from the associated piece, wherein the male part comprises an elongate insertion member vertically projecting from its associated piece and adapted to be inserted into the channel member of the female part through the open side of the channel member, the channel member and the insertion member each comprising wall members projecting from their associated flat piece by a predetermined height, said female part being provided with hinge carrier means at an edge opposite the channel member, said male part being provided with hinge carrier means at an edge opposite the insertion member, said hinge carrier means protruding to the same side as the corresponding channel member on the female part and to the same side as the corresponding insertion member on the male part, the hinge carrier means thus locating a hinge joint spaced in a perpendicular direction from a plane of the flat piece of the male part and in a perpendicular direction from a plane of the flat piece of the female part at a distance which corresponds substantially to one half of the height of the channel member and of the insertion member, wherein the internal width of the channel member and the external width of the insertion member are dimensioned to provide means for bringing the insertion member into engagement with the channel member with a part of a container lying in between the two members and with both pieces lying parallel to each other, the wall members of the channel member of the female part having internal surfaces, the wall members of the insertion member of the male part having external surfaces, the internal surfaces of the channel member and the cooperating external surfaces of the insertion member all being substantially parallel when the clamp is in a closed condition.

2. Clamp according to claim 1, wherein the wall members of the channel member and the insertion member have approximately the same height.

3. Clamp according to claim 1, wherein the wall members of the channel member and insertion member each have the same height and wherein the hinge axis is spaced apart from said plane by a distance which corresponds half the height of said walls.

4. Clamp according to claim 1, wherein the flat pieces of the female part and the male part together with the hinge define a U-shaped clamp when the insertion member is engaged into the channel member.

5. Clamp according to claim 1, wherein the walls defining the channel member and the insertion member are projecting from the flat pieces of the open clamp parallel to each other, when the flat pieces are lying within the same plane.

6. Clamp according to claim 1, wherein the female part and the male part are consisting of a pair of walls substantially protruding at right angles from their associated flat pieces.

* * * * *